US008403730B2

(12) United States Patent
Numata et al.

(10) Patent No.: US 8,403,730 B2
(45) Date of Patent: Mar. 26, 2013

(54) STOPPER DEVICE FOR GRINDING STONE COVER OF GRINDER

(75) Inventors: Fumitoshi Numata, Anjo (JP); Hirokazu Kimata, Anjo (JP)

(73) Assignee: Makita Corporation, Anjo-shi (JP)

( * ) Notice: Subject to any disclaimer, the term of this patent is extended or adjusted under 35 U.S.C. 154(b) by 416 days.

(21) Appl. No.: 12/734,134

(22) PCT Filed: Oct. 10, 2008

(86) PCT No.: PCT/JP2008/068476

§ 371 (c)(1),
(2), (4) Date: Apr. 13, 2010

(87) PCT Pub. No.: WO2009/054275

PCT Pub. Date: Apr. 30, 2009

(65) Prior Publication Data

US 2010/0210195 A1 Aug. 19, 2010

(30) Foreign Application Priority Data

Oct. 22, 2007 (JP) ..... 2007-273733

(51) Int. Cl.
*B24B 23/00* (2006.01)

(52) U.S. Cl. ..... 451/359; 451/344; 451/457; 451/459

(58) Field of Classification Search ..... 451/344, 451/353, 359, 451, 455, 357, 459, 360
See application file for complete search history.

(56) References Cited

U.S. PATENT DOCUMENTS

| | | | | |
|---|---|---|---|---|
| 3,068,620 | A | 12/1962 | Tocci-Guilbert | |
| 5,005,321 | A * | 4/1991 | Barth et al. | 451/359 |
| 5,163,252 | A * | 11/1992 | Garner et al. | 451/451 |
| 5,545,082 | A * | 8/1996 | Courson et al. | 451/456 |
| 5,766,062 | A * | 6/1998 | Edling | 451/451 |
| 6,289,571 | B1 * | 9/2001 | Ozawa et al. | 29/521 |
| 6,688,955 | B2 * | 2/2004 | Ruey-Zon | 451/360 |
| 7,014,547 | B2 * | 3/2006 | Kleider | 451/359 |
| 7,311,589 | B2 * | 12/2007 | Wiker | 451/451 |
| 7,927,191 | B2 * | 4/2011 | Esenwein | 451/451 |
| 2007/0052142 | A1 * | 3/2007 | Muraoka | 267/140.11 |

FOREIGN PATENT DOCUMENTS

| | | |
|---|---|---|
| JP | U-54-112688 | 8/1979 |
| JP | A-56-28844 | 3/1981 |
| JP | U-63-67074 | 5/1988 |
| JP | A-2000-135687 | 5/2000 |

OTHER PUBLICATIONS

International Search Report issued in International Application No. PCT/JP2008/068476 by the International Bureau on Nov. 25, 2008. (with English translation).

* cited by examiner

*Primary Examiner* — George Nguyen
(74) *Attorney, Agent, or Firm* — Oliff & Berridge, PLC

(57) ABSTRACT

A grinder can include a stopper projection provided to a grinding stone cover and position a stopper abutting portion on a side of a gear housing in order to restrict a position adjustable range through abutment of the stopper projection to the stopper abutting portion in a position where the grinding stone cover has rotated in a rotational direction of the grinding stone by a set angle.

12 Claims, 9 Drawing Sheets

STOPPER DEVICE FOR GRINDING STONE COVER OF GRINDER

TECHNICAL FIELD

The present invention relates to a stopper device for a grinding stone cover of a hand-held grinder, which is used, for example, for grinding materials such as stones.

BACKGROUND ART

A hand-held grinder has a main body portion having a substantially cylindrical body shape that receives an electric motor therein, the main body portion is used as a grip portion, which is held by a user for a grinding operation, etc. A speed reduction portion is provided at a front portion of the main body portion for reducing the rotational output of the electric motor by a bevel gear train and outputting it in a perpendicular direction. For this purpose, a spindle on an output side of the speed reduction portion extends perpendicular to a motor shaft. A circular grinding stone (wheel) is attached to the spindle. In general, a substantially semi-circumferential range on a rear side of the grinding stone (a user side) is covered with a cover for preventing powder dust or the like (hereinafter simply referred to as dust), which is generated during a grinding operation, from scattering towards the user.

This cover for the grinding stone can be removed for the convenience of an exchanging operation, etc., as disclosed, for example, in a patent document listed below and can change its position by rotating about an axis of the spindle within an appropriate range in consideration of the working postures of a user, etc. The positional change of this grinding stone cover can be made by loosening fixing screws, etc.

Patent Document 1: Japanese Laid-Open Utility Model Publication No. 56-28844

However, this kind of grinding stone cover has accompanied the following problems. As described above, because it is constructed to enable the position of the grinding stone to change about an axis of the spindle to an arbitrary position by loosening a fixing screw, a problem may be caused that cutting chips scatter towards a user if the position is adjusted, when it is opened toward the user at a large angle, and therefore, the construction for enabling the position to be changed to an arbitrary position (a position adjustment function) may rather impair the usability from a viewpoint of prevention of dust from scattering.

Further, if the tightening of the fixing screw after the positional adjustment is weak, the grinding stone cover may, for example, contact the other parts so that the position may be largely displaced in an opening direction, resulting to bring it into a condition so that the a dust scattering prevention function is impaired in some cases.

Thus, there is a need in the art for a dust scattering prevention function to be reliably executed without substantially impairing a position adjustment function of a grinding cover.

SUMMARY

Therefore, the present invention provides a stopper device, which has a construction as defined in each of the claims.

According to the stopper device defined in claim 1, the grinding stone cover is supported on the gear housing such that the position can be changed about the axis of the spindle, and therefore, by adjusting the position to a most suitable position in accordance with a mode of operation, etc., it is possible to prevent dusts from scattering towards a user while improving the efficiency of operation. Further, because the position changeable range of the grinding stone cover in the rotational direction of the grinding stone is restricted to a predetermined range by the stopper device, the user may not adjust the position by mistake to a position wherein the dust scattering prevention function may be substantially impaired, and even in the case that the grinding stone cover has contacted the other parts, the grinding stone cover may not accidentally move to a position where the dust scattering prevention function may be substantially impaired.

According to the stopper device as defined in claim 2, by positioning the edge portion of the grinding stone cover at the reference position orthogonal to the body length in a plan view, it is possible to most effectively prevent the dust from scattering towards user while it is possible to ensure the workability, for example, by exposing half the circumferential region on the front side of the grinding stone. A sufficiently practical position adjustable range can be ensured without substantially impairing the dust scattering prevention function by restricting a position adjustable range (opening angle θ from the reference position) from the reference position in the rotational direction of the grinding stone to an angle of 60 degrees (θ=60°).

According to the stopper device defined in claim 3, the position adjustable range can securely be restricted by bringing the stopper protrusion portion in to abutment to the stopper abutting portion on the gear housing side.

According to the stopper device defined in claim 4, the position adjustable range in the rotational direction of the grinding stone is restricted at a predetermined position through abutment of the fixing screw tightening portion of the mounting band portion of the grinding stone cover to the stopper abutting portion on the gear housing side, thereby enabling to reliably ensure the dust scattering prevention function of the grinding stone cover while the operability in accordance with the mode of operation can be ensured.

Further, because the stopper abutting portion is constructed such that it can be mounted by together tightening by means of the screw for mounting the gear housing to the main body portion, the stopper abutting portion can be easily post-mounted so that the stopper device can be widely applied to a grinder already in use by post-mounting.

According to the stopper device defined in claim 5, the displacement of the stopper projection in the spindle axis direction can be more reliably restricted. Therefore, the stopper projection is prevented from being removed in the spindle axis direction from the stopper abutting portion due to the impact applied when the stopper projection abuts the stopper abutting portion, so that the opening angle of the grinding stone cover from the reference position can be further reliably restricted.

BEST MODES FOR CARRYING OUT THE INVENTION

Figure 1:
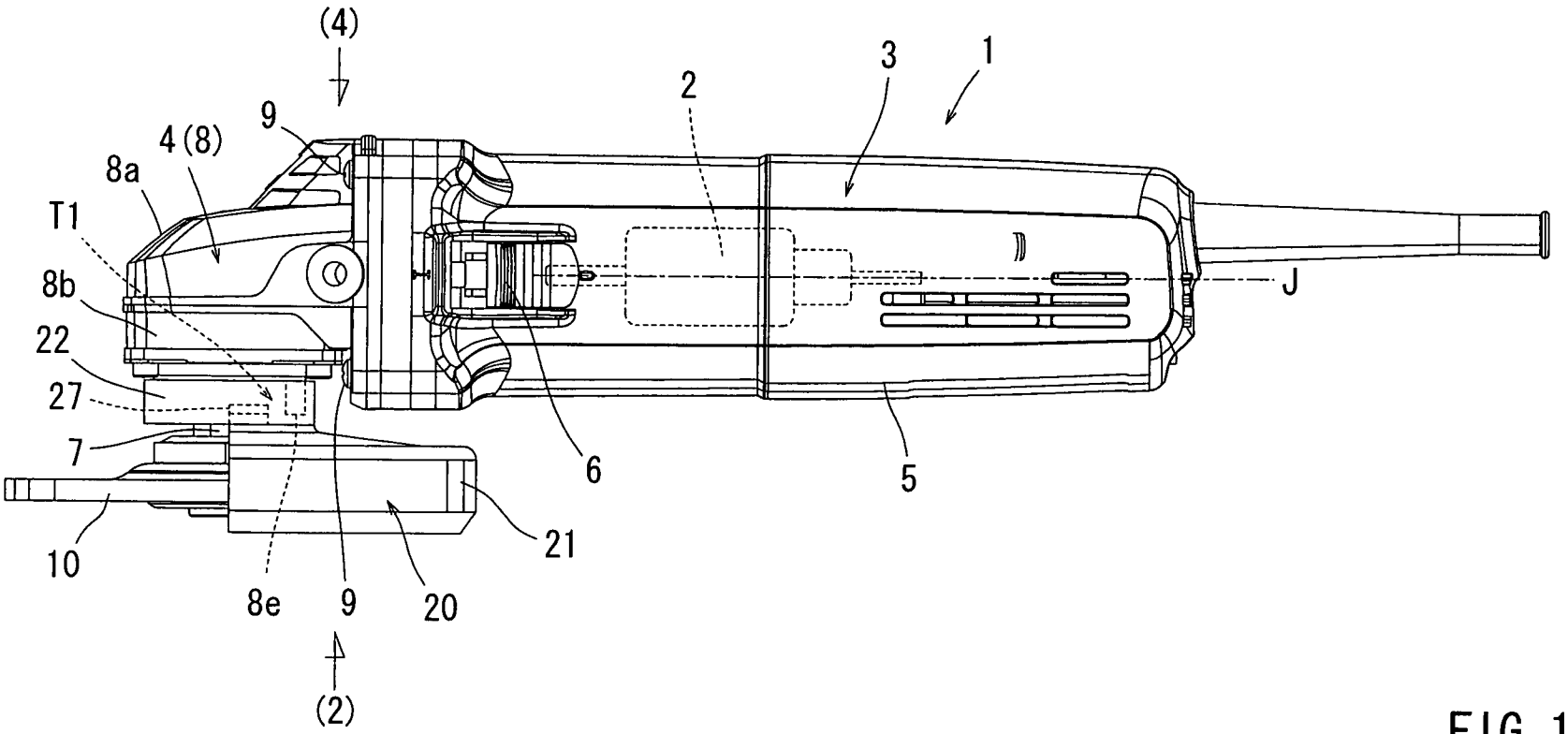
[FIG. 1] An entire side view of a grinder having a stopper device according to a first embodiment of the present invention.

Next, embodiments of the present invention will be described with reference to FIGS. 1 to 11. FIG. 1 shows a grinder 1 having a stopper device T1 according to a first embodiment. A fundamental construction of the grinder 1 needs no particular change for this embodiment, however, it will be briefly described below. A left side in FIG. 1 will be referred to as a front side of the grinder 1 and a right side will be referred to as a rear side.

The grinder 1 includes a main body portion 3 and a speed reduction gear portion 4. The main body portion 3 includes a main body housing 5 having a substantially cylindrical configuration. An electric motor 2 serving as a power source is received within the main body housing 5. The main body housing 5 and the main body portion 3 also serve as a grip portion having such a thickness that allows a user to easily hold it. The user may be positioned on a rear side of the main body portion 3 to hold the main body portion 3. A main switch 6 of a slide operation type is disposed on a side portion of the main body portion 3. The electric motor 2 starts when the main switch 6 is slidably operated with a fingertip of a hand holding the main body portion 3.

The speed reduction gear portion 4 is provided at a front portion of the main body portion 3. The rotational output of the electric motor 2 is reduced by the speed reduction gear portion 4 and is then outputted to a spindle 7. The speed reduction gear portion 4 is configured to have a bevel gear train within a gear housing 8. Therefore, the rotational axis of the spindle 7 is orthogonal to the rotational axis of the electric motor 2 (body length direction J) as viewed from the lateral side.

In this specification, the side view means a direction of orienting the side surface of the grinder 1 is to the front side (a direction as shown in FIG. 1) and a plan view means a direction of orienting an upper surface of the grinder 1 to the front side (a direction as viewed from an arrow (4) direction in FIG. 1).

Figure 2:
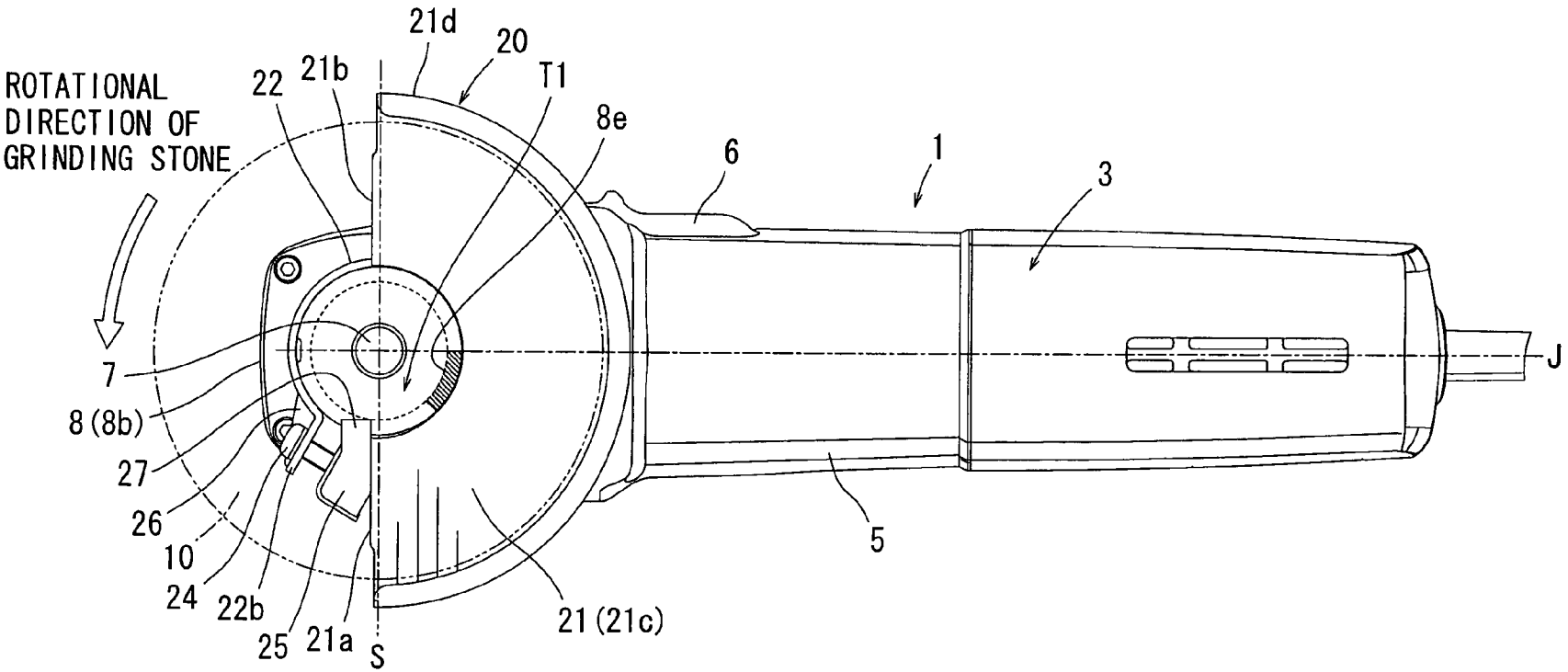
[FIG. 2] A bottom view of the grinder having the stopper device according to the first embodiment as viewed from an arrow (2) direction in FIG. 1. This figure shows a state where a grinding stone cover is positioned in a reference position. In this figure, a rotational direction of the grinding stone corresponds to a counterclockwise direction.
Figure 3:
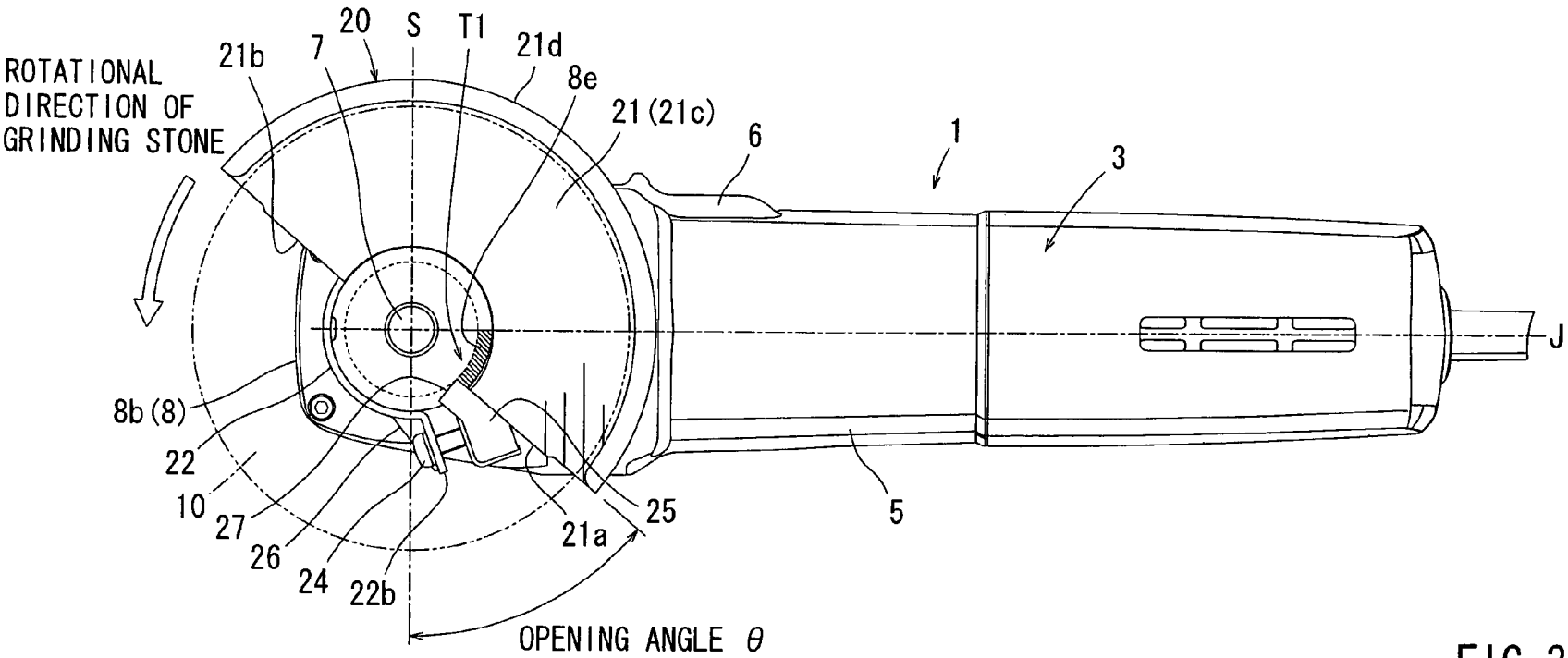
[FIG. 3] A bottom view similar to FIG. 2 of the grinder having the stopper device according to the first embodiment as viewed from an arrow (2) direction in FIG. 1. This figure shows a restricted state, in which the grinding stone cover has been rotated by an angle of about 60 degree from the reference position in the rotational direction of the grinding stone. In this figure, there is shown a state where a stopper projection 27 abuts a stopper abutting portion 8*e*. In this figure, the rotational direction of the grinding stone corresponds to a counterclockwise direction.
Figure 4:
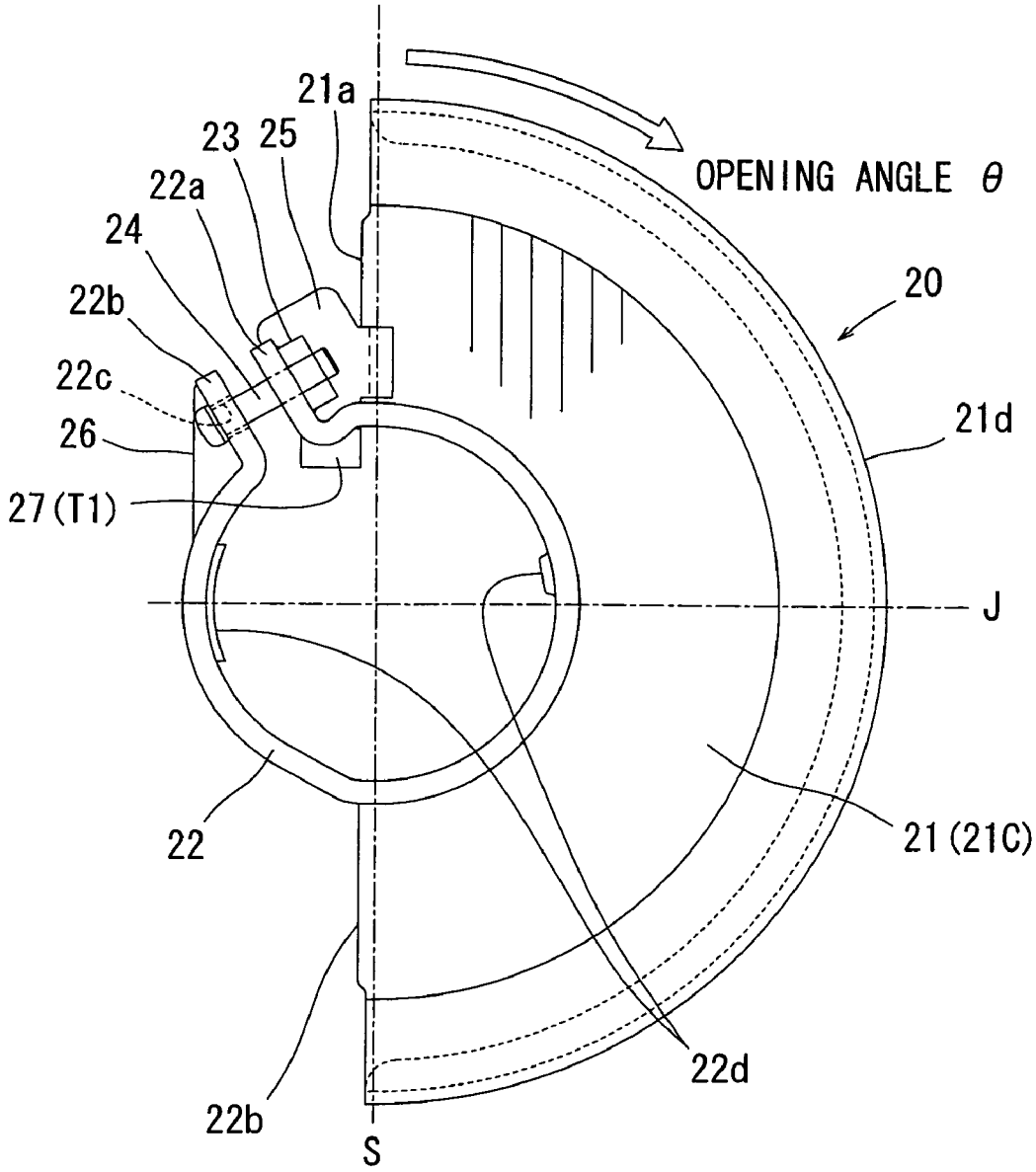
[FIG. 4] A plan view of the grinding stone cover as viewed from an arrow (4) direction in FIG. 1. This figure shows a state where the grinding stone cover is being alone after removed from a gear housing. In this figure, a rotational direction of the grinding stone corresponds to a clockwise direction as indicated by an outline arrow.

The gear housing 8 has a two-body construction with an upper portion 8*a* and a lower portion 8*b* that are respectively connected to a front end portion of the main body housing 5 by means of mounting screws 9-9. The spindle 7 protrudes downwardly from a lower portion of the gear housing 8*b*, and a circular grinding stone 10 is attached to this protruding portion. The grinding stone 10 rotates in a clockwise direction in the plan view. A substantially semi-circumferential portion of a rear side of this grinding stone 10 (on a user side, right side in FIG. 1, hereinafter the same shall apply) is covered with a grinding stone cover 20 for preventing dust, such as cutting chips, from scattering towards the user. The details of this grinding stone cover 20 are shown in FIG. 2 to FIG. 4.

The grinding stone cover 20 includes a cover main body portion 21 for covering the substantially semi-circumferential portion of the rear side of the grinding stone and a mounting band portion 22 that is provided on an upper portion of the cover main body portion 21 and is fixed in a state of being wound around the gear housing 8. The cover main body portion 21 includes a semi-circular part (a semi-circular portion 21*c*) for covering an upper side of the grinding stone 10 and a part bent in a semi-circular arc configuration (a semi-circular bent portion 21*d*), which is provided along the circumference of the semi-circular portion 21*c* in order to shield an outer circumferential side of the grinding stone 10. Both edge portions 21*a*, 21*b* of the semi-circular portion 21*c* are positioned substantially on the same line with each other. Mainly, a region of a rear side half of the grinding stone 10 is covered with the cover main body portion 21 so that powder dust, etc. is prevented from scattering towards the user (rear side).

The grinding stone cover 20 is fixed in a position for covering the rear side of the grinding stone 10 by fixing the mounting band portion 22 to the gear housing 8. As shown in FIG. 4, the mounting band portion 2 is formed by bending a band steel plate into a circular shape and a cylindrical tubular portion 8*c* (see FIG. 5 and FIG. 6) of the gear housing 8*b* is inserted into its inner circumference side. Both end portions of the mounting band portion 22 are bent respectively towards the outer circumferential side by an angle of about 90 degrees to form fixing screw tightening portions 22*a*, 22*b*, which are opposed to each other. A nut 23 is welded to one of the fixing screw tightening portions 22*a*. An insertion hole 22*c* for a fixing screw 24 is formed in the other fixing screw tightening portion 22*b*.

Reinforcement plates 25, 26 are respectively attached to fixing screw tightening portions 22*a*, 22*b* by welding. The reinforcement plate 25 is attached so as to extend between the lower portion of the fixing screw tightening portion 22*a* and the upper surface of the cover main body portion 21. The reinforcement plate 26 is attached so as to extend between the lower portion of the fixing screw tightening portion 22*b* and the mounting band portion 22. As the bent condition of both fixing screw tightening portions 22*a*, 22*b* towards the outer circumferential side (a condition opposed to each other) is firmly maintained and the tightened condition of the fixing screw 24 is maintained, a mounted condition (wound condition) of the mounting band portion 22 with respect to the gear housing 8 is maintained so that inadvertent loosening is prevented.

A stopper projection 27 is integrally formed with the reinforcement plate 25 disposed on a side of the fixing screw portion 22*a*. The stopper projection 27 protrudes toward an inner circumferential side of the mounting band portion 22. The function of this stopper projection 27 will be described later.

Figure 5:
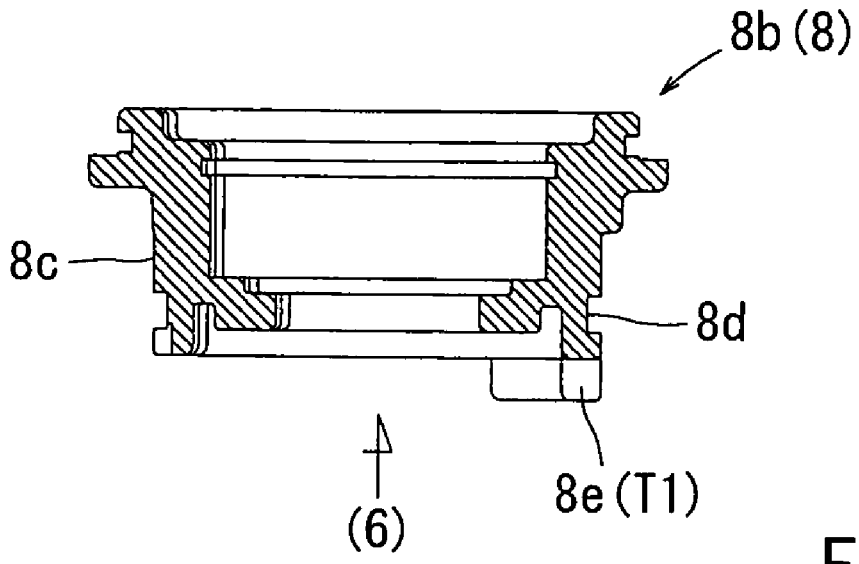
[FIG. 5] A vertical-sectional view of a lower portion of the gear housing for the stopper device according to the first embodiment.
Figure 6:
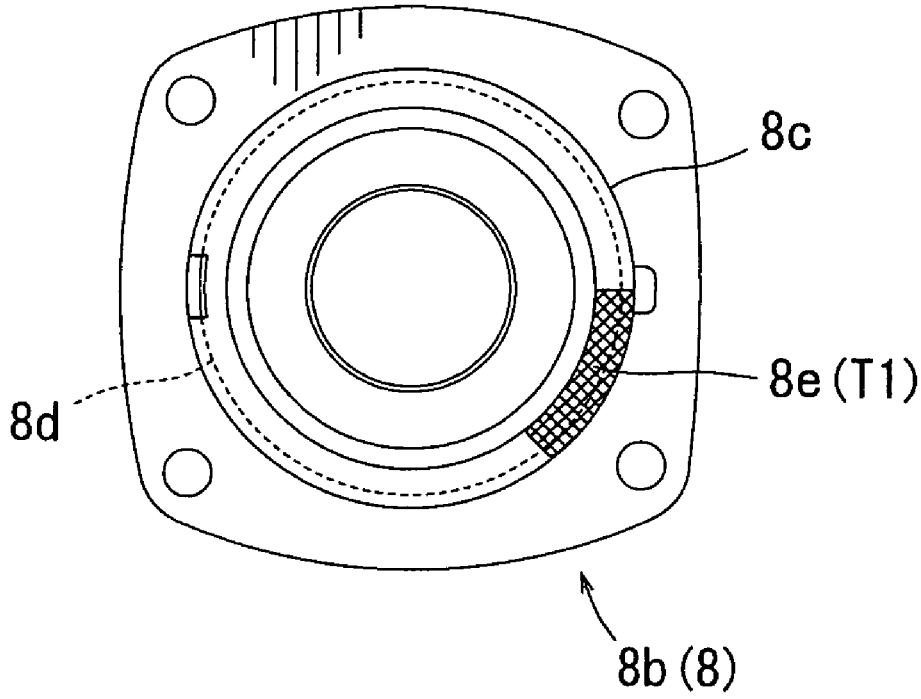
[FIG. 6] A bottom view of the lower portion of the gear housing for the stopper device according to the first embodiment as viewed from an arrow (6) direction in FIG. 5.

Further, a removal preventing protrusion 22*d* for preventing removal from the gear housing lower portion 8*b* is provided on an inner circumferential surface of the mounting band portion 22. The details of the gear housing lower portion 8*b* are shown in FIGS. 5 and 6. A removal preventing recess 8*d* is formed in the entire outer circumferential surface of a cylindrical tubular portion 8*c* of the gear housing lower portion 8*b*, in which the removal preventing protrusion 22*d* is inserted. The cylindrical tubular portion 8*c* of the gear housing lower portion 8*b* is inserted into the inner circumferential side of the mounting band portion 2 in the state that the removal preventing protrusion 22*d* is inserted into the removal preventing recess 8*d*. In this inserted state, the mounting band portion 22 is fixed in a state of being wound around the cylindrical tubular portion 8*c* by tightening the fixing screw 24 so that the grinding stone cover 20 is fixed to the gear housing 8.

Although it is omitted in FIGS. 5 and 6, a bearing for rotatably supporting the spindle or a seal ring for preventing dust, etc., is assembled on the inner circumferential side of the gear housing lower portion 8*b*. The spindle 7 is supported in a state of protruding in a downward direction from the center of the gear housing lower portion 8*b*.

The stopper abutting portion 8*e* is integrally formed with a lower surface of the gear housing lower portion 8*b*. The stopper abutting portion 8*e* is provided along the lower surface of the cylindrical portion 8*c* within such a range that satisfies the following function. The stopper abutting portion 8*e* and the above stopper projection 27 form a stopper device T1 of the present embodiment.

As shown in FIGS. 2 and 3, when the grinding stone cover 20 is attached to the gear housing 8, the stopper projection 27 provided to the mounting band portion 22 opposes to the above stopper abutting portion 8*e* in a circumferential direction. On the other hand, the grinding stone cover 8 can be rotated about an axis of the spindle 7 as a center by loosening the fixing screw 24, and therefore, a range of the grinding stone 10 covered with the cover main body portion 21 (shielded range) can be moved within a predetermined range.

Consequently, although the shielded range of the grinding stone 10 can be adjusted by bringing the grinding stone cover 20 into the state of being rotatable around the axis of the spindle 7 by loosening the fixing screw 24, the adjustable range is restricted within a predetermined range as the stopper projection 27 is abutted to the stopper abutting portion 8*e* as shown in FIG. 3. In this embodiment, the position adjustable range of the grinding stone cover 20 (an opening angle θ from a reference position S) is restricted from the reference position S (a position as shown in FIG. 2), in which a front edge portion 21*a* on the front side with respect to the rotational direction of the grinding stone (counterclockwise direction in FIGS. 2 and 3) extends orthogonal to the body length direction J of the main body portion 3, to an opening angle of 60 degrees (θ=60°) also in the rotational direction of the grinding stone as indicated by an outline arrow in FIG. 4. FIG. 3 shows a state, in which the grinding stone cover 20 is rotated by the maximum opening angle of 60 degrees in the rotational direction of the grinding stone.

More specifically, if the grinding stone cover 20 is rotated by 60 degrees from the reference position S in the rotational direction (counterclockwise direction in FIG. 3, clockwise direction in FIG. 4) of the grinding stone 10 as shown in FIG. 3, further rotation is prevented as the stopper projection 27 abuts the end portion of the stopper abutting portion 8*e* so that the position adjustable range of the grinding stone cover 20 with respect to the rotational direction of the grinding stone 10 can be restricted.

In the opposite direction to the rotational direction of the grinding stone 10, the operation can be conveniently performed because the position can be adjusted within a large angular range as conventionally available, without restriction of the position adjustable range of the grinding stone cover 20 from the reference position S by the stopper projection 27 and the stopper abutting portions 8*e*. Regarding the positional adjustment performed by rotating the grinding stone cover 20 from the reference position S in a clockwise direction as shown in FIG. 2, it may have little influence with regard to scattering of dust towards the user because it opens in an opposite direction (clockwise direction in FIG. 2) relative to the rotational direction of the grinding stone 10. For this reason, in the present embodiment, the position adjustable range is not restricted by means of the stopper projection 27 and the stopper abutting portion 8*e*, and therefore, the grinding stone cover 20 can be widely opened from the reference position S in an opposite direction relative to the rotational direction of the grinding stone to facilitate the operation.

According to the grinding stone cover 20 of the present embodiment constructed as described-above, because the position adjustable range (opening angle θ) from the reference position S with respect to the rotational direction of the grinding stone 10 can be restricted to a maximum angle of 60 degrees, it is possible to prevent the user from accidentally setting the opening angle too large, and therefore, it is possible to prevent dust from scattering towards the user as a result of operation.

Further, even in the case that the cutting chips etc., have scattered and collided against the grinding stone cover 20, the grinding stone cover 20 may not be displaced in accordance with the rotation of the grinding stone 10, if the grinding stone cover 20 is fixed by firmly tightening the fixing screw 24. However, in this case, the mounting band portion 22 of the grinding stone cover 20 may excessively tighten the cylindrical tubular portion 8*c* of the gear housing 8, and as a result, it may cause adverse effects on a bearing (not shown) that supports the spindle 7. Also, it may be troublesome to loosen or tighten the fixing screw in the case that the grinding stone cover 20 is rotated to a desired angle in accordance with the work.

With respect to this viewpoint, according to the present invention, because the fixing screw is used by appropriately tightening the same, and therefore, even if the grinding stone cover 20 is displaced in the rotational direction due to the impact caused by scattering of cutting chips, further rotation is prevented as the stopper projection 27 abuts the stopper abutting portion 8*e* at the opening angle θ, which is 60 degrees at the maximum from the reference position S so that cutting chips etc., are prevented from scattering towards the user.

Moreover, the function for restricting the position adjustable range by the stopper projection 27 and the stopper abutting portion 8*e* may work within the position adjustable range of the grinding stone cover 20 in the rotational direction of the grinding stone, while the position adjustment can be made within the position adjustable range in the opposite direction to the rotational direction of the grinding stone by a large angle as conventionally available, and therefore, the above operation and effects can be obtained without imparing the position adjustment function of the grinding stone cover 20 even in the case that a diamond wheel is mounted instead of the grinding stone to form grooves on, for example, concrete.

Various modifications may be made to the above described embodiment. For example, it exemplified the construction in which the stopper projection 27 is provided integrally with the reinforcement plate 25 for reinforcing the fixing screw tightening portion 22*a*, however, it may be provided to the other portion, such as the circumference of the mounting band portion 22 or the cover main body portion 21. Further, the portion to which the stopper abutting portion 8*e* is provided is not limited to the above-exemplified portion and may be provided to the other portion in accordance with the position of the above stopper projection. In short, similar effects can be obtained by providing the stopper projection and the stopper abutting portion in such a manner that the opening angle θ is restricted to have a maximum angle of 60 degrees from the reference position S when the position is adjusted by rotating the grinding stone cover 20 in the rotational direction of the grinding stone.

Figure 7:
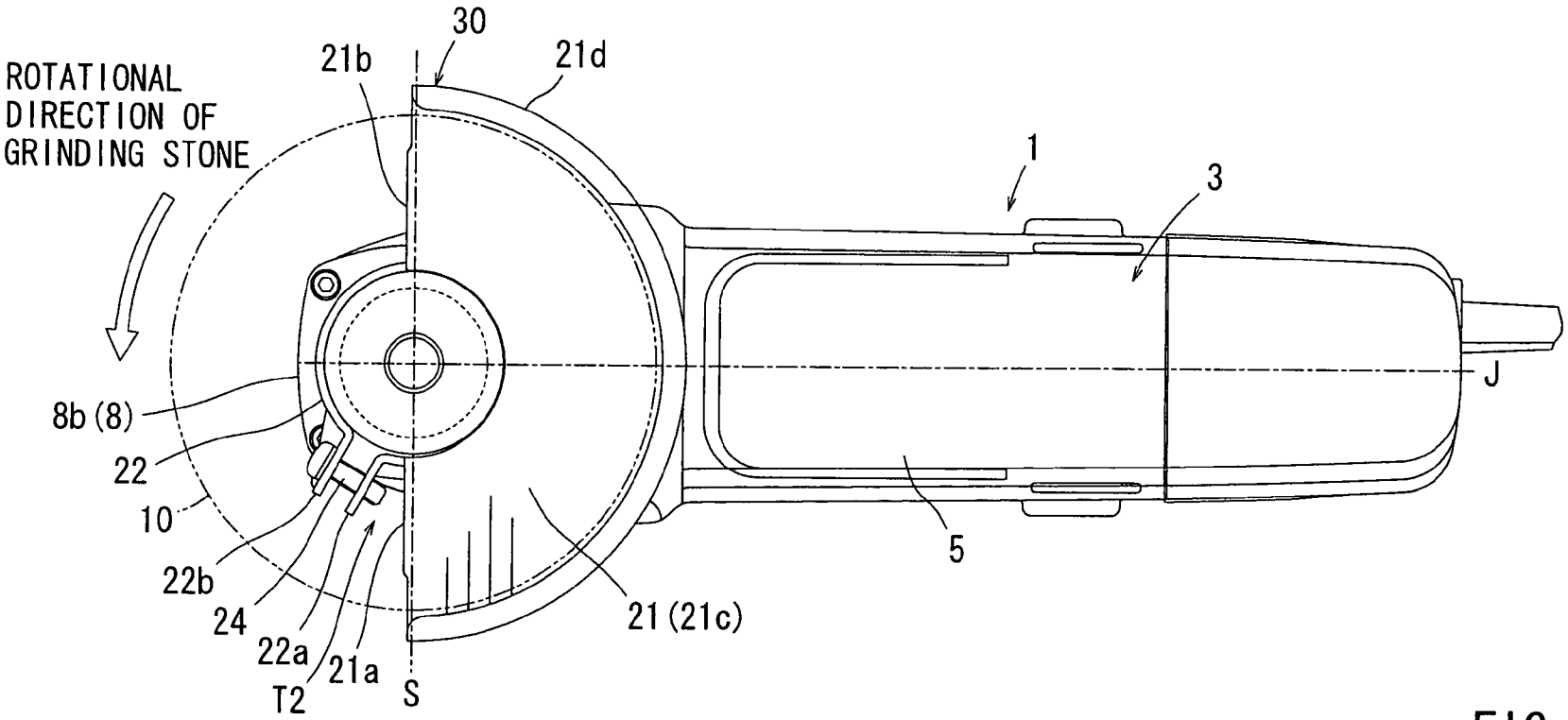
[FIG. 7] A bottom view of an entire grinder having a stopper device of a second embodiment. The figure shows a state, in which the grinding stone cover is fixed in a reference position. In this figure, a rotational direction of the grinding stone corresponds to a counterclockwise direction.
Figure 8:
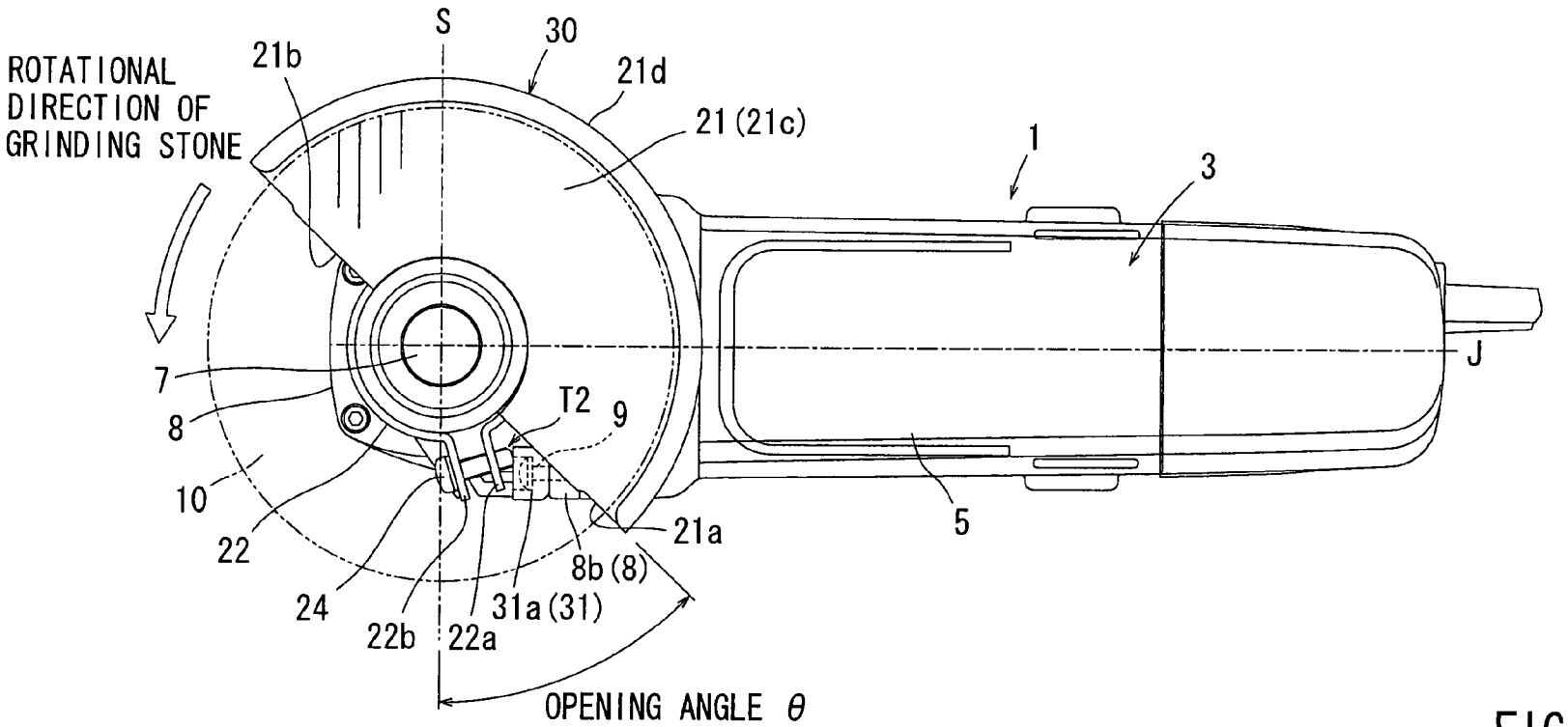
[FIG. 8] A bottom view of the entire grinder having the stopper device of the second embodiment. In this figure, there is shown a restricted state, in which the grinding stone cover has been rotated by an angle of about 60 degrees from the reference position in the rotational direction of the grinding stone. In this figure, there is shown a state, in which a tip end portion of a fixing screw 24 abuts a stopper main body 31*a* that is tightened together on the gear housing. In this figure, a rotational direction of the grinder corresponds to the counterclockwise direction.
Figure 9:
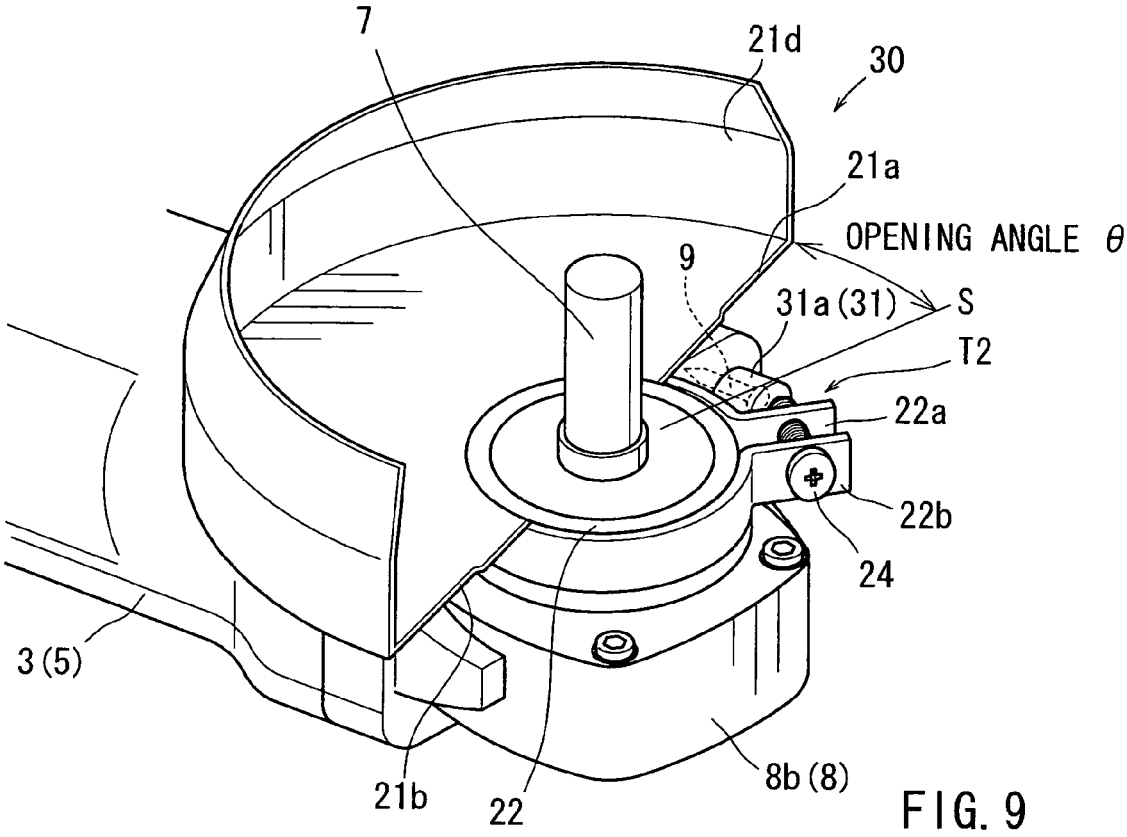
[FIG. 9] A perspective view showing a front portion turned upside down of the grinder having a stopper device according to the second embodiment. In this figure, a grinding stone 10 is omitted not to be shown.

Further, according to the above-exemplified embodiment, it was exemplified to newly provide the stopper projection 27 and the stopper abutting portion 8*e* as the stopper device T1, however, the same operation and effects can be obtained by adding only the stopper abutting portion. In FIGS. 7 to 9, a stopper device T2 according to a second embodiment is shown. The stopper device T2 according to the second embodiment has a construction, in which the stopper projection 27 of the stopper device T1 according to the first embodiment is omitted. Regarding the other constructions, a grinding stone cover 30 of the second embodiment is constructed the same as the grinding stone cover 20 of the first embodiment. The same reference numerals will be used for the same members and the constructions as the first embodiment, which do not require any particular changes, and their description will be omitted.

As shown in FIG. 9, a stopper abutting portion 31 according to the second embodiment is provided on a front side of both of the fixing screw tightening portions 22*a*, 22*b* of the mounting band portion 22 for the grinding stone cover 30 with respect to the rotational direction of the grinding stone. The stopper abutting portion 31 has a construction in which the cylindrical tubular stopper main body 31*a* and the gear housing 8 are together tightened with the main body housing 5 by a single mounting screw 9. In the second embodiment, the mounting screw 9 with sufficiently longer length than in the first embodiment is used in order to together tighten the stopper main body 31*a*.

The stopper abutting portion 31 is provided in a state of entering the movement path of both fixing screw tightening portions 22*a*, 22*b* in accordance with the rotation of the grinding stone cover 30 in the rotational direction of the grinding stone. Therefore, when the position of the shielded range for the grinding stone 10 is adjusted by rotating the grinding stone cover 30 in the rotational direction of the grinding stone, further rotation is prevented as the leading end portion of the fixing screw tightening portion 22*a* or the fixing screw 24 abuts the stopper abutting portion 31. In the second embodiment as well, the position adjustable range of the grinding stone cover 30 in the rotational direction of the grinding stone is restricted to the opening angle θ that is 60 degrees at the maximum from the reference position S.

As described above, according to the stopper device T2 of the second embodiment, the same operation and effects can be obtained as of the first embodiment only by additionally providing the stopper main body 31*a* on the side of the gear housing 8, while the grinding stone cover 30 can be used as it remains to have the conventional construction.

Figure 10:
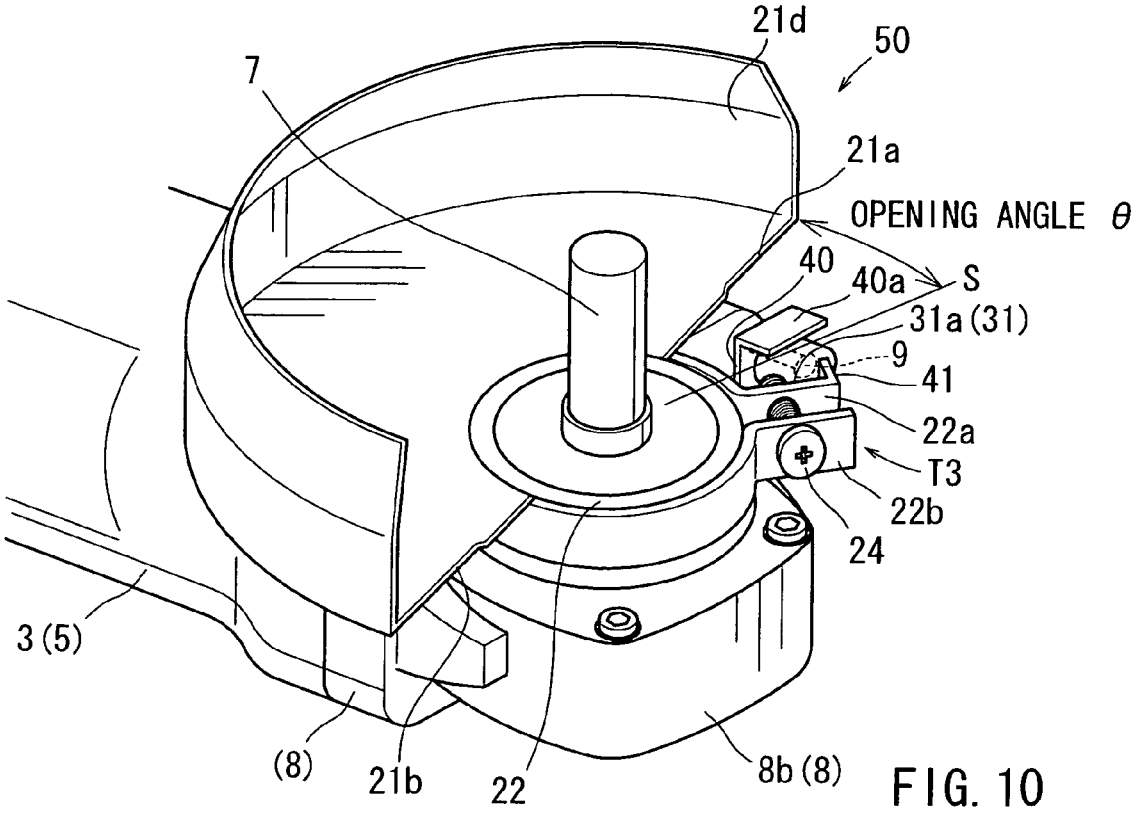
[FIG. 10] A perspective view showing a front portion turned upside down of a grinder having a stopper device according to a third embodiment. In this figure, a grinding stone 10 is omitted not to be shown.

Moreover, additional modifications may be made to the above second embodiment. FIG. 10 shows a stopper device T3 according to the third embodiment. The stopper device T3 according to the third embodiment includes a stopper fitting 4 in addition to the cylindrical tubular stopper main body 31*a* that is used in the second embodiment. Also, a stopper projection 41 is integrally formed with the fixing screw tightening portion 22*a* of a grinding stone cover 50. Similar to the second embodiment, the stopper fitting 40 is fixed on the side of the gear housing 8 by being tightened together by the mounting screw 9. The stopper fitting 40 is fixed in the state of being clamped between the stopper main body 31 a and a front surface of the gear housing 8. An upper portion of the stopper fitting 40 is bent towards the front side as illustrated (front side in FIG. 10) to form an L-shaped configuration (bent portion 40*a*). The bent portion 40*a* extends along over the upper side of the stopper main body portion 31*a*.

The stopper projection 41 is provided with a bent leading end side of the fixing screw tightening portion 22*a*, which is bent further into an L-shape towards the front side with respect to the rotational direction of the grinding stone.

Also with the stopper device T3 according to the third embodiment, in the case that the position about the spindle axis of the grinding stone cover 50 is adjusted by loosening the fixing screw 24, if the edge portion 21*a* is positioned orthogonal to the body length direction J and is rotated by 60 degrees from the reference position S in the rotational direction of the grinding stone the stopper projection 41 abuts the stopper main body 31*a* so that further rotation of the grinding stone cover 50 in the rotational direction of the grinding stone is prevented and the position adjustable range of the grinding stone cover 50 is restricted. Consequently, similar to the first and the second embodiments, the user may not set the opening angle of the grinding stone cover 50 too large in the rotational direction of the grinding stone, and therefore, dust is prevented from scattering towards the user.

Furthermore, even in the case that the grinding stone cover 50 is displaced in the rotational direction of the grinding stone by the impact applied when the cutting chips etc., are scattered and collide against the grinding stone cover 5, scattering of cutting chips etc., towards the user may be prevented because it is possible to prevent further rotation through abutment of the stopper projection 41 to the stopper main body 31*a* at the opening angle θ that is 60 degrees at the maximum from the reference position S.

Moreover, similar to the second embodiment, the restriction function of the position adjustable range by means of the stopper projection 41 and the stopper main body portion 31*a*, works for the position adjustable range of the grinding stone cover 50 in the rotational direction of the grinding stone, and it is possible to adjust the position by a large open angle as conventionally available for the position adjustable range in an opposite direction to the rotational direction of the grinding stone, and therefore, the above-described operation and effects can be obtained without substantially impairing the position adjustment function of the grinding stone cover 50.

Also, the bent portion 40*a* is provided on an upper portion of the stopper fitting 40 of the third embodiment. The bent portion 40*a* extends along over the upper side of the stopper main body 31*a*. With the bent portion 40*a*, the upward displacement of the stopper projection 41 abutted to the stopper main portion 31*a* is restricted so that its removal is prevented, and therefore, the position adjustable range restricting function of the stopper device T3 can be reliably exercised because the abutting condition can be reliably maintained.

Figure 11:
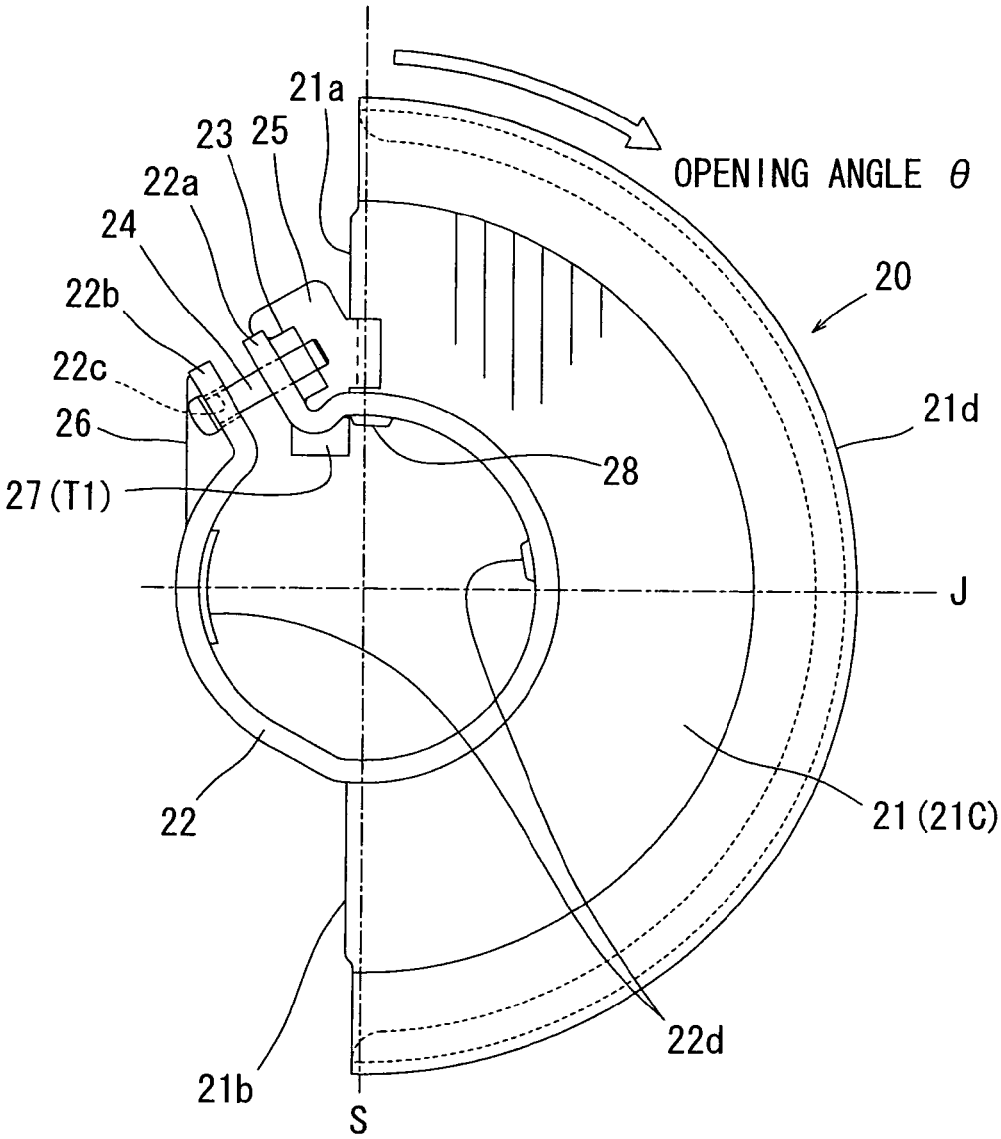
[FIG. 11] A plan view of the grinding stone cover according to another embodiment, in which a stopper restricting portion is provided at the grinding stone cover of the first embodiment.

The additional modifications may be respectively made to the above-described third embodiment. For example, as shown in FIG. 11, the opening angle θ of the grinding stone cover 20 can be reliably restricted by providing a stopper restricting protrusion 28 in a position adjacent to the stopper projection 27 of the first embodiment. Similar to the removal preventing protrusion 22*d*, the stopper restricting protrusion 28 is provided on the inner circumferential surface of the mounting band portion 22 in a position very close to the stopper projection 27. When the mounting band portion 22 is mounted to the cylindrical tubular portion 8*c* of the lower portion of the gear housing 8*b*, similar to the removal preventing protrusion 22*d*, the stopper restricting protrusion 28 is brought into the state of being inserted into the removal preventing recess 8*d*. By the stopper restricting protrusion 28 and the removal preventing portion 22*d*, the displacement of the mounting band portion 22 as well as the grinding stone cover 20 in an axial direction of the spindle 7 (a direction for removal with respect to the lower portion of the gear housing lower portion 8*b*) is restricted.

Specifically, the displacement of the stopper projection 27 in the spindle axial direction may be more reliably restricted by the stopper restriction protrusion 28. As a result, it is possible to more reliably prevent the stopper projection 27 from displacing in the spindle axis direction and being removed from the stopper abutting portion 8*e* due to, for example, the deflection of the member caused by the impact generated when the stopper projection 27 abuts the stopper abutting portion 8*e* as the grinding stone cover 20 is rotated, and therefore, the opening angle θ of the grinding stone cover 20 may be more reliably restricted since the abutting condition of the stopper projection 27 to the stopper abutting portion 8*e* is reliably maintained.

The stopper restricting protrusion 28 is not limited to be applied to the first embodiment but can also be applied to the second and the third embodiments. By applying the stopper restriction protrusion 28 to the third embodiment, the abutting condition of the stopper projection 41 to the stopper fitting 40 can be more reliably maintained by means of the stopper restricting protrusion 28 in addition to the bent portion 40*a*.

Also, it may be constructed such that the mounting band portion 22 and the grinding stone cover 20 are rotatably supported about the spindle 7 within a predetermined angle range are prevented from displacing in the spindle axis direction by providing a single removal preventing protrusion, which continuously extends along the entire circumference of the inner circumferential surface of the mounting band portion 2, and inserting it along the inside of the removal preventing recess 8*d* of the gear housing lower portion 8*b*. In this case, a portion of the removal preventing protrusion proximal to the stopper projection 27, which continuously extends along the inner circumferential surface of the mounting band portion 22, has the same function as the stopper restricting protrusion 28.

Further, for example, for the stopper devices T1, T2, T3, there have been respectively exemplified the constructions in which the position adjustable ranges of the grinding stone covers 20, 30, 50 in the rotational direction of the grinding stone from the reference position S are restricted to the opening angle θ that is about 60 degrees at the maximum, however, the opening angle θ can be arbitrary determined to, for example, an angle of around 50 degrees or around 70 degrees in accordance with the scattering condition of the dust or the like. Moreover, the stopper device can be set so that the position can adjusted only in an opposite direction to the rotational direction of the grinding stone by setting the position adjustable range in the rotational direction of the grinding stone to 0 degree (reference position S) from the reference position S.

Also, there has been exemplified a relatively small grinder with the main body housing 5 that also serves as a grip portion, however, it is possible to similarly apply to a grinding stone cover for a relatively large grinder that has a separate dedicated grip portion on a rear portion of a main body housing.

The invention claimed is:

1. A grinder comprising:

a main body portion including a drive source, a speed reduction gear portion reducing a rotational output of the drive source, a spindle having a rotational axis in an orthogonal direction to a body length direction of the main body portion as viewed from a lateral side, and a grinding stone cover covering a part of a circumference of a circular grinding stone mounted to the spindle, and a stopper device configured to support the grinding stone cover on a gear housing receiving the speed reduction gear portion therein such that a position can be changed about the axis of the spindle to change a range of covering the circumference of the grinding stone, so that a position adjustable range about the axis of the spindle in the rotational direction of the grinding stone is restricted, wherein:

the stopper device includes a first stopper member attached to the grinding stone cover, and a second stopper member attached to the gear housing, the first stopper member can abut to the second stopper member in the rotational direction of the grinding store when the first stopper member is at an abutting position, the second stopper member does not interfere with the movement of the first stopper member when the first stopper member moves from the abutting position in a direction opposite to the rotational direction of the grinding stone.

2. The grinder as defined in claim 1, wherein the grinding stone cover includes an edge portion along a radial direction with respect to the axis of the spindle as a center as viewed in a plan view, and the restriction is made from a reference position where the edge portion is orthogonal to a body length direction of the main body portion, to an opening angle of 60 degrees at the maximum in the rotational direction of the grinding stone.

3. The grinder as defined in claim 2, wherein the grinding stone cover includes a cover main body portion covering a circumference of the grinding stone and a mounting band portion, which is wound around the gear housing by tightening a fixing screw for mounting the grinding stone cover to the gear housing, wherein the first stopper member is a stopper projection provided on the mounting band portion to extend towards an inner circumferential side thereof, and the second stopper member is a stopper abutting portion configured to abut the stopper projection and provided on the gear housing, so that a position changeable range in the rotational direction of the grinding stone is restricted through abutment of the stopper projection to the stopper abutting portion.

4. The grinder as defined in claim 2, wherein the grinding stone cover includes a cover main body portion covering a circumference of the grinding stone and a mounting band portion, which is wound around the gear housing by tightening a fixing screw for mounting the grinding stone cover to the gear housing, wherein the first stopper member is a fixing screw tightening portion, which is provided on the mounting band portion to extend towards an outer circumferential side thereof, and the second stopper member is a stopper abutting portion, which is fixed by together tightening a mounting screw used for mounting the gear housing to the main body portion, and the position changeable range in the rotational direction of the grinding stone is restricted through abutment of the fixing screw tightening portion to the stopper abutting portion.

5. The grinder as defined in claim 4, wherein a removal preventing protrusion portion is provided for preventing a displacement in an axial direction of the spindle by being inserted into a removal preventing recess provided in an outer circumferential surface of the gear housing so that a portion of the removal preventing protrusion proximal to the first stopper member serves as a stopper restricting protrusion for restricting a displacement in the axial spindle direction of the first stopper member relative to the stopper abutting portion.

6. The grinder as defined in claim 1, wherein:

the grinding stone cover includes a cover main body portion covering a circumference of the grinding stone and a mounting band portion, which is wound around the gear housing by tightening a fixing screw for mounting the grinding stone cover to the gear housing, the first stopper member is attached to the mounting band portion, and the first stopper member is fixed in position with respect to a radial direction about the spindle axis.

7. The grinder as defined in claim 1, wherein:

the grinding stone cover includes a cover main body portion covering a circumference of the grinding stone and a mounting band portion, which is wound around the gear housing by tightening a fixing screw for mounting the grinding stone cover to the gear housing, the first stopper member is attached to the mounting band portion, and the first stopper member and the second stopper member are positioned on a radially outer side of the mounting band portion with respect to a radial direction about the spindle axis.

8. A grinder comprising:

a main body portion including a drive source, a speed reduction gear portion reducing a rotational output of the drive source, a spindle having a rotational axis in an orthogonal direction to a body length direction of the main body portion as viewed from a lateral side, and a grinding stone cover covering a part of a circumference of a circular grinding stone mounted to the spindle, wherein the grinding stone cover is supported on a gear housing receiving the speed reduction gear portion therein such that a position can be changed about the axis of the spindle to change a range of covering the circumference of the grinding stone, so that a position adjustable range about the axis of the spindle in the rotational direction of the grinding stone is restricted, and wherein the grinding stone cover includes a cover main body portion covering a circumference of the grinding stone and a mounting band portion, which is wound around the gear housing by tightening a fixing screw for mounting the grinding stone cover to the gear housing, wherein the position changeable range in the rotational direction of the grinding stone is restricted through abutment of a fixing screw tightening portion, which is provided on the mounting band portion to extend towards an outer circumferential side thereof, to a stopper abutting portion, which is fixed by together tightening a mounting screw used for mounting the gear housing to the main body portion.

9. The grinder as defined in claim 8, wherein a removal preventing protrusion portion is provided for preventing a displacement in the spindle axis direction by being inserted into a removal preventing recess provided in an outer circumferential surface of the gear housing so that a portion of the removal preventing protrusion proximal to the stopper projection serves as a stopper restricting protrusion for restricting a displacement in the spindle axis direction of the stopper projection relative to the stopper abutting portion.

10. The grinder as defined in claim 8, wherein the grinding stone cover includes an edge portion along a radial direction with respect to the axis of the spindle as a center as viewed in a plan view, and the restriction is made from a reference position where the edge portion is orthogonal to a body length direction of the main body portion, to an opening angle of 60 degrees at the maximum in the rotational direction of the grinding stone.

11. A grinder comprising:

a main body portion including a drive source, a speed reduction gear portion reducing a rotational output of the drive source, a spindle having a rotational axis in an orthogonal direction to a body length direction of the main body portion as viewed from a lateral side, and a grinding stone cover covering a part of a circumference of a circular grinding stone mounted to the spindle, wherein the grinding stone cover is supported on a gear housing receiving the speed reduction gear portion therein such that a position can be changed about the axis of the spindle to change a range of covering the circumference of the grinding stone, so that a position adjustable range about the axis of the spindle in the rotational direction of the grinding stone is restricted;

wherein the grinding stone cover includes a cover main body portion covering a circumference of the grinding stone and a mounting band portion, which is wound around the gear housing by tightening a fixing screw for mounting the grinding stone cover to the gear housing, wherein a stopper projection is provided on the mounting band portion to extend towards an inner circumferential side thereof, and a stopper abutting portion abutting the stopper projection is provided on the gear housing, so that a position changeable range in the rotational direction of the grinding stone is restricted through abutment of the stopper projection to the stopper abutting portion; and wherein a removal preventing protrusion portion is provided for preventing a displacement in the spindle axis direction by being inserted into a removal preventing recess provided in an outer circumferential surface of the gear housing so that a portion of the removal preventing protrusion proximal to the stopper projection serves as a stopper restricting protrusion for restricting a displacement in the spindle axis direction of the stopper projection relative to the stopper abutting portion.

12. The grinder as defined in claim 11, wherein the grinding stone cover includes an edge portion along a radial direction with respect to the axis of the spindle as a center as viewed in a plan view, and the restriction is made from a reference position where the edge portion is orthogonal to a body length direction of the main body portion, to an opening angle of 60 degrees at the maximum in the rotational direction of the grinding stone.

* * * * *